US005400512A

United States Patent [19]

Brush

[11] Patent Number: 5,400,512

[45] Date of Patent: Mar. 28, 1995

[54] WINDSHIELD MOLDING REMOVING KNIFE

[76] Inventor: Jerry L. Brush, 26437 104th Ave. SE., #C301, Kent, Wash. 98031

[21] Appl. No.: 203,824

[22] Filed: Mar. 1, 1994

[51] Int. Cl.[6] ..... B26B 1/04

[52] U.S. Cl. ..... 30/321; 7/100; 30/340

[58] Field of Search ..... 30/340, 155, 329, 330, 30/280, 342, 320, 321; 7/100; 29/270, 275

[56] References Cited

U.S. PATENT DOCUMENTS

| | | | |
|---|---|---|---|
| 1,387,246 | 8/1921 | Earle | 30/340 |
| 2,659,143 | 11/1953 | Baker | 30/340 |
| 3,372,459 | 3/1968 | Lambright | 29/270 |
| 4,395,825 | 8/1983 | Lock | 29/275 |
| 4,730,394 | 3/1988 | Sonner, Jr. | 30/155 |
| 4,955,124 | 9/1990 | Asbery | 29/426.4 |

*Primary Examiner*—Hwei Siu Payer

[57] ABSTRACT

A windshield molding removing knife comprising a body having a tip end and a base end; a head having a tip end and a base end formed for use as a gear; a retaining mechanism coupled to the tip end of the head for holding a knife blade therein in an extended position for cutting; a neck having a base end slidably received in the tip end of the body and a tip end pivotally coupled to the base end of the head for allowing pivotal movement of the head; and a locking mechanism having one orientation for coupling the neck to the body at a given position and another orientation for allowing the extension or retraction of the neck within the body.

2 Claims, 3 Drawing Sheets

WINDSHIELD MOLDING REMOVING KNIFE

BACKGROUND OF THE INVENTION

1. Field of the Invention

The present invention relates to windshield molding removing knives and more particularly pertains to cutting molding in order to remove the windshield of a vehicle with an angularly adjustable knife.

2. Description of the Prior Art

The use of tools for removing windshields is known in the prior art. More specifically, tools heretofore devised and utilized for the purpose of cutting molding in order to remove the windshield of a vehicle are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 300,600 to High discloses a tool handle for replaceable knife blades; U.S. Pat. No. 3,448,517 to Cothery discloses a windshield removing tool; U.S. Pat. No. 3,711,677 to Cummins discloses an automobile windshield and backglass removal tool; U.S. Pat. No. 4,080,734 to Barbour discloses a method and apparatus for removing a vehicle windshield; U.S. Pat. No. 4,199,852 to Ayers discloses a windshield remover; and U.S. Pat. No. 4,694,576 to Cothery discloses a tool for removing windshield sealant.

While these devices fulfill their respective, particular objective and requirements, the aforementioned patents do not describe a windshield molding removing knife whose extent is extendable, retractable, and pivotable.

In this respect, the windshield molding removing knife according to the present invention substantially departs from the conventional concepts and designs of the prior art, and in doing so provides an apparatus primarily developed for the purpose of cutting molding in order to remove the windshield of a vehicle.

Therefore, it can be appreciated that there exists a continuing need for new and improved windshield molding removing knife which can be used for cutting molding in order to remove the windshield of a vehicle. In this regard, the present invention substantially fulfills this need.

SUMMARY OF THE INVENTION

In the view of the foregoing disadvantages inherent in the known types of tools now present in the prior art, the present invention provides an improved windshield molding removing knife. As such, the general purpose of the present invention, which will be described subsequently in greater detail, is to provide a new and improved windshield molding removing knife and method which has all the advantages of the prior art and none of the disadvantages.

To attain this, the present invention essentially comprises in combination, a generally tubular and rigid body having a tip end and a base end. An elongated and rigid head is provided and has a generally hollow tip end and a sealed generally semi-circular base end with a plurality of teeth formed thereon creating a gear. A trapezoidal utility knife blade is provided. Retaining means are coupled within the tip end of the head for holding the utility knife blade therein in an extended position for cutting. An elongated neck is provided and has a base end telescopically received in the tip end of the body and a tip end pivotally coupled to the base end of the head. The tip end has an aperture disposed thereon with an elongated latch disposed therein. A latch is provided and has a spring at one end and a detent at the other end. The latch has one orientation with the detent urged toward the teeth of the gear for locking the position of the head relative to the neck and another orientation with the detent urged away from the teeth of the gear for allowing pivotal movement of the head relative to the neck. An elongated plunger is provided and is slidably disposed within the body for extending or retracting the neck from the body. The plunger has a head with a telescopic drive rod extending therefrom. The head has an upper portion coupled to the base end of the neck, a lower portion, a cavity formed between the upper portion and lower portion, a hole centrally disposed therethrough, a flexible disk disposed within the cavity with a threaded aperture formed therethrough axially aligned with the hole, and a threaded bolt having one end coupled within the aperture and the other end extending therefrom towards the base end of the body. The drive rod has a first end coupled to the extended end of the bolt and a second end projecting towards the base end of the body. A cap is coupled to the second end of the drive rod and is rotatably coupled about the base end of the body for setting and adjusting the extension of the neck from the body, whereby when the cap is rotated in one direction, the drive rod rotates the bolt to expand the disk, thus coupling the neck to the body at a given position, and when the cap is rotated in the other direction, the drive rod rotates the bolt to contract the disk, thus allowing axial movement of the neck within the body.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved windshield molding removing knife which has all the advantages of the prior art tools and none of the disadvantages.

It is another object of the present invention to provide a new and improved windshield molding removing knife which may be easily and efficiently manufactured and marketed.

It is a further object of the present invention to provide a new and improved windshield molding removing knife which is of durable and reliable construction.

An even further object of the present invention is to provide a new and improved windshield molding removing knife which is susceptible of a low cost of manufacture with regard to both materials and labor, and which accordingly is then susceptible of low prices of sale to the consuming public, thereby making such a windshield molding removing knife economically available to the buying public.

Still yet another object of the present invention is to provide a new and improved windshield molding removing knife which provides in the apparatuses and methods of the prior art some of the advantages thereof, while simultaneously overcoming some of the disadvantages normally associated therewith.

Even still another object of the present invention is to provide a new and improved windshield molding removing knife cutting windshield molding for cutting molding in order to remove the windshield of a vehicle.

Lastly, it is an object of the present invention is to provide a new and improved windshield molding removing knife comprising a body having a tip end and a base end; a head having a tip end and a base end formed for use as a gear; retaining means coupled to the tip end of the head for holding a knife blade therein in an extended position for cutting; a neck having a base end slidably received in the tip end of the body and a tip end pivotally coupled to the base end of the head for allowing pivotal movement of the head; and locking means having one orientation for coupling the neck to the body at a given position and another orientation for allowing the extension or retraction of the neck within the body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
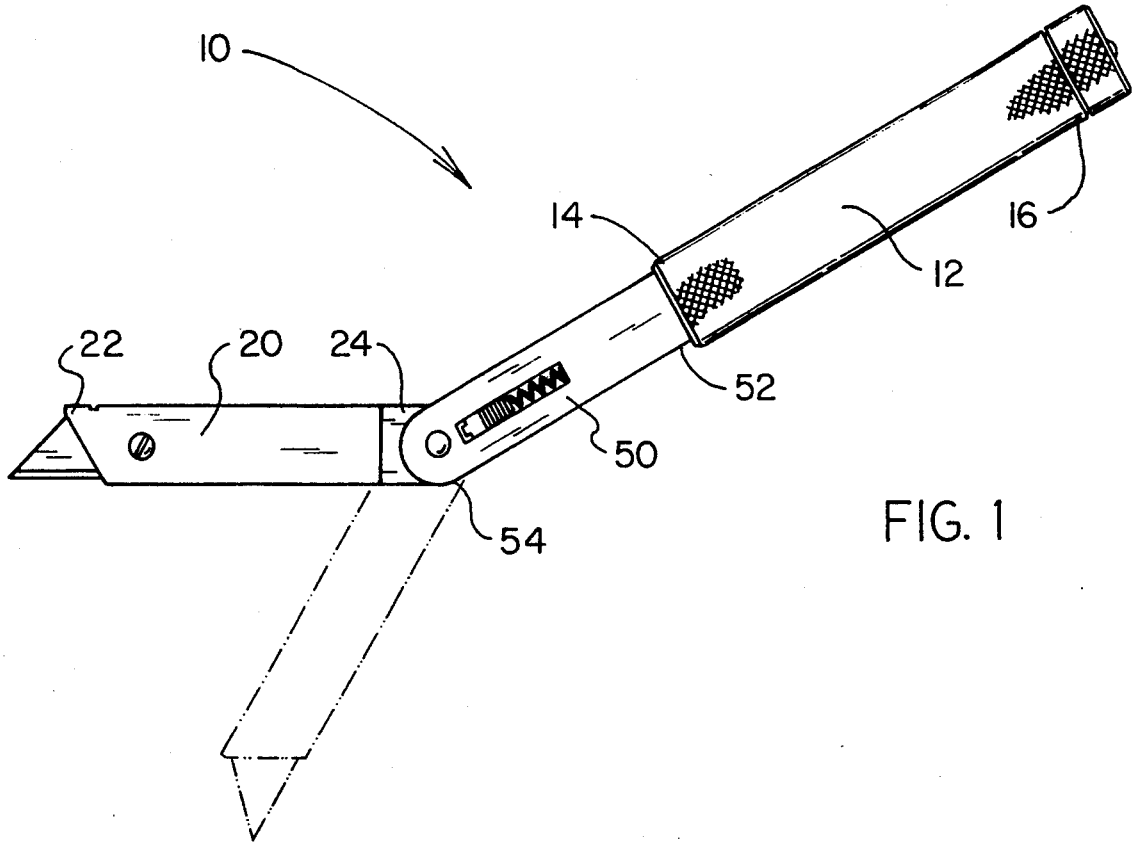
FIG. 1 is a side elevational view of the preferred embodiment of the windshield molding removing knife constructed in accordance with the principles of the present invention.
Figure 2:
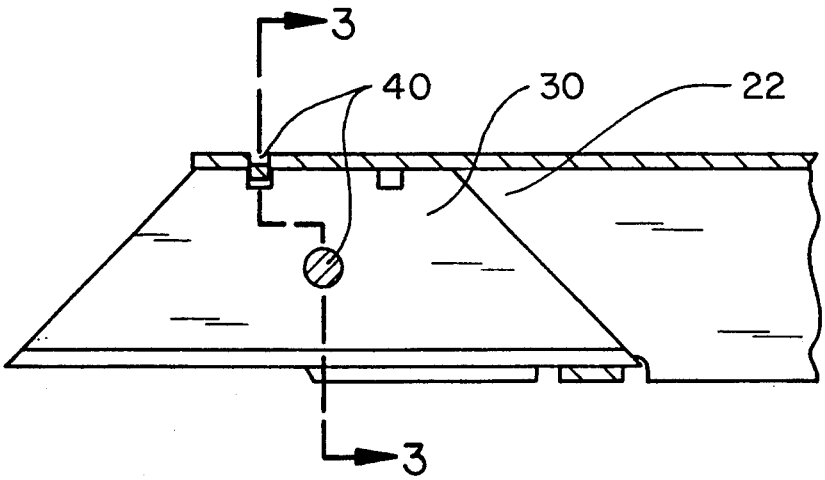
FIG. 2 is an enlarged view of the tip end of the head with a trapezoidal utility knife blade disposed therein.
Figure 3:
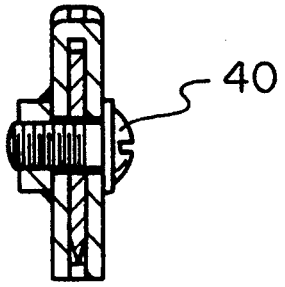
FIG. 3 is a cross sectional view of the retaining means used to couple a utility knife blade within the head of the present invention taken along the line 3—3 of FIG. 2.
Figure 4:
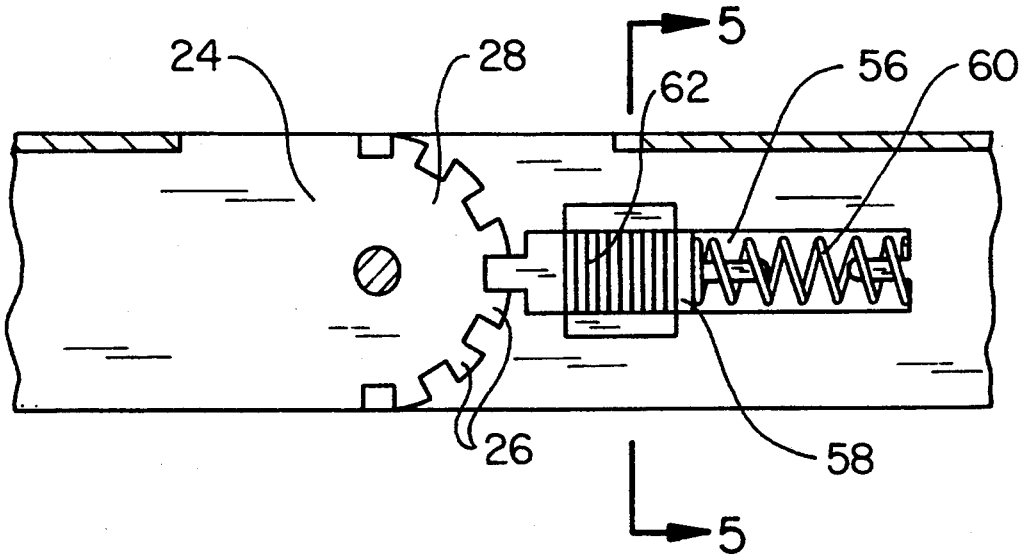
FIG. 4 is a cross sectional view of the rotatable coupling between the head and neck of the present invention.
Figure 5:
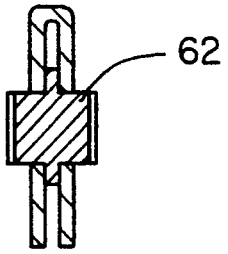
FIG. 5 is a cross sectional view of the spring loaded latch taken along the line 5—5 of FIG. 4.
Figure 6:
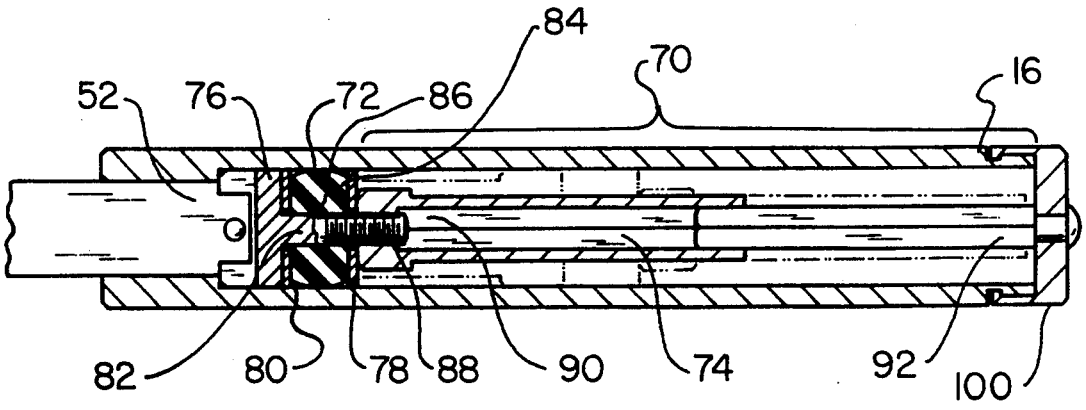
FIG. 6 is a cross sectional view of the slidable coupling between the plunger and neck of the present invention.

With reference now to the drawings, and in particular, to FIG. 1 thereof, the preferred embodiment of the new and improved windshield molding removing knife embodying the principles and concepts of the present invention and generally designated by the reference number 10 will be described.

Specifically, the present invention includes seven major components. The major components are the body, head, knife blade, retaining means, neck, plunger, and cap. These components are interrelated to provide the intended function.

More specifically, it will be noted in the various Figures that the first major component is the body 12. The body is generally tubular and rigid in structure. The body has a tip end 14 and a base end 16. The body is formed with a cross-hatched surface structure in order to provide a user a firm grip.

The second major component is the head 20. The head is elongated and rigid in structure. The head has a generally hollow tip end 22 and a sealed generally semicircular base end 24. The base end has a plurality of teeth 26 formed thereon to create a gear 28. The head is formed with a hollow aperture therein in order to store extra knife blades for future use.

The third major component is the knife blade 30. The knife blade is trapezoidal in structure. It has a cutting edge disposed thereon. It also has a plurality of spaced notches formed on an edge opposite the cutting edge for coupling with the body. The notches allow the length of the cutting end extended from the head to be adjusted. A central mounting hole disposed therethrough to allow the blade to be held in a set orientation within the head. The head is adapted to be opened and closed in order to reverse the trapezoidal knife blade therein when its cutting edge is dull.

The fourth major component is the retaining means 40. The retaining means is coupled within the tip end 22 of the head. The retaining means holds the knife blade in an extended position from the tip for cutting. The retaining means includes a downwardly extending detent that is projected toward the interior of the head. This detent is urged within a notch of a blade placed in the head to hold the cutting edge of the knife blade at a given extension. The retaining means also includes a threaded bore disposed therethrough near the tip end. Once the central mounting hole of the knife blade and the bore are aligned, a bolt is disposed through the head, whereby coupling the blade therein.

The fifth major component is the neck 50. The neck is elongated and rigid in structure. The neck includes a base end 52 telescopically received in the tip end 14 of the body. The neck 50 also includes a tip end 54 pivotally to the base end 24 of the head. The tip end has an aperture 56 disposed thereon with an elongated latch 58 disposed therein.

Furthermore, with respect to the tip end of the neck, the latch also has a spring 60 at one end and a detent 62 at the other end. The latch can be positioned in one orientation with the detent urged toward the teeth 26 of the gear for locking the position of the head 20 relative to the neck. The latch can also be placed in another orientation with the detent urged away from the teeth of the gear for allowing pivotal movement of the head relative to the neck.

The sixth major component is the plunger 70. The plunger is elongated and rigid in structure. The plunger is disposed within the body 12. The plunger is used to extend or retract the neck 50 from the body. The plunger has a head 72 with a telescopic drive rod 74 extending therefrom.

The head of the plunger has an upper portion 76 coupled to the base end of the neck. The head also includes a lower portion 78 with a cavity 80 formed between the upper portion and the lower portion. A hole 82 is centrally disposed through the head from the upper portion to the lower portion. A flexible and expandable disk 84 is disposed within the cavity. The disk has a threaded aperture 86 formed therethrough. The aperture is axially aligned with the hole 82. The head also includes a threaded bolt 88. The threaded bolt has one end coupled within the aperture 86 and another end extending therefrom towards the base end 16 of the body.

Furthermore, with respect to the plunger, the drive rod has a first end 90 and a second end 92. The first end is coupled to the extended end of the bolt. The second end projects from the first end towards the base end 16 of the body.

The seventh major component is the cap 100. The cap is coupled to the second end 92 of the drive rod and rotatably coupled about the base end 16 of the body. The cap allows a user to set and adjust the extension of the neck 50 from the body 12. When the cap is axially rotated with respect to the body in one direction, the drive rod rotates the bolt 88 to expand the disk 84, thus coupling the neck to the body at a given position. When the cap is axially rotated with respect to the body in the other direction, the drive rod rotates the bolt to contract the disk, thus allowing axial movement of the neck within the body.

In the preferred embodiment, the major components are made of metal or any other rigid material. The knife blade is conventional in structure and commercially available. Extra knife blades can be stored within the head. The base and the neck are designed to extend to a length of about 13 inches. The disk used for securing the neck to the base is made of rubber and is about one half of an inch thick. The gear on the base end of the head allows the tip end of the head to be locked in any one of seven angular positions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A windshield molding removing knife for cutting molding in order to remove the windshield of a vehicle comprising, in combination:

a generally tubular and rigid body having a tip end and a base end;

an elongated and rigid head having a generally hollow tip end and a sealed generally semi-circular base end having a plurality of teeth formed thereon creating a gear;

a trapezoidal utility knife blade;

retaining means coupled within the tip end of the head for holding the utility knife blade therein in an extended position for cutting;

an elongated neck having a base end telescopically received in the tip end of the body and a tip end pivotally coupled to the base end of the head, the tip end of the neck having an aperture disposed thereon with an elongated latch disposed therein, the latch having a spring at one end and a detent at the other end, the latch having one orientation with the detent urged toward the teeth of the gear for locking the head relative to the neck and another orientation with the detent urged away from the teeth of the gear for allowing pivotal movement of the head relative to the neck;

an elongated plunger slidably disposed within the body for extending or retracting the neck from the body, the plunger having a head with a telescopic drive rod extending therefrom; the plunger head having an upper portion coupled to the base end of the neck, a lower portion, a cavity formed between the upper portion and lower portion, a hole centrally disposed therethrough, a flexible disk disposed within the cavity with a threaded aperture formed therethrough axially aligned with the hole, and a threaded bolt having one end coupled within the aperture and the other end extending therefrom towards the base end of the body; the drive rod having a first end coupled to said other end of the bolt and a second end projecting towards the base end of the body; and a cap coupled to the second end of the drive rod and rotatably coupled about the base end of the body for setting and adjusting the neck with respect to the body, whereby when the cap is rotated in one direction, the drive rod rotates the bolt to expand the disk, thus coupling the neck to the body at a given position, and when the cap is rotated in the other direction, the drive rod rotates the bolt to contact the disk, thus allowing axial movement of the neck within the body.

2. A windshield molding removing knife comprising:

a body having a tip end and a base end;

a head having a tip end and a base end having gear means formed thereon;

retaining means coupled to the tip end of the head for holding a knife blade therein in an extended position for cutting;

a neck having a base end slidably received in the tip end of the body and a tip end coupled to the gear means for allowing pivotal adjustment of the head with respect to the neck;

locking means having one orientation for coupling the neck to the body at a given position and another orientation for allowing the extension or retraction of the neck within the body; and a knife blade coupled within the retaining means.

* * * * *